US007246660B2

(12) United States Patent
Fripp et al.

(10) Patent No.: US 7,246,660 B2
(45) Date of Patent: Jul. 24, 2007

(54) BOREHOLE DISCONTINUITIES FOR ENHANCED POWER GENERATION

(75) Inventors: Michael L. Fripp, Carrollton, TX (US); Marthinus van Schoor, Medford, MA (US); John Rodgers, Trophy Club, TX (US); Roger L. Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 315 days.

(21) Appl. No.: 10/658,899

(22) Filed: Sep. 10, 2003

(65) Prior Publication Data

US 2005/0051323 A1 Mar. 10, 2005

(51) Int. Cl.
*E21B 43/00* (2006.01)

(52) U.S. Cl. ..... 166/65.1; 290/54

(58) Field of Classification Search ..... 166/65.1, 166/66.5; 138/40, 44; 137/625.28, 625.3; 290/43, 52, 54, 4 D
See application file for complete search history.

(56) References Cited

U.S. PATENT DOCUMENTS

| | | | | |
|---|---|---|---|---|
| 2,481,222 | A * | 9/1949 | Jones | 290/52 |
| 2,960,109 | A * | 11/1960 | Wilson | 137/517 |
| 2,978,634 | A * | 4/1961 | Arps | 73/702 |
| 3,342,267 | A | 9/1967 | Cotter et al. | |
| 4,015,234 | A | 3/1977 | Krebs | |
| 4,215,426 | A | 7/1980 | Klatt | |
| 4,416,000 | A | 11/1983 | Scherbatskoy | |
| 5,101,907 | A | 4/1992 | Schultz et al. | |
| 5,202,194 | A | 4/1993 | VanBerg, Jr. | |
| 5,295,397 | A * | 3/1994 | Hall et al. | 73/861.02 |
| 5,626,200 | A | 5/1997 | Gilbert et al. | |
| 5,839,508 | A * | 11/1998 | Tubel et al. | 166/65.1 |
| 6,011,346 | A * | 1/2000 | Buchanan et al. | 310/339 |
| 6,424,079 | B1 | 7/2002 | Carroll | |
| 6,504,258 | B2 | 1/2003 | Schultz et al. | |
| 6,554,074 | B2 * | 4/2003 | Longbottom | 166/372 |
| 6,607,030 | B2 | 8/2003 | Bauer et al. | |
| 6,672,409 | B1 * | 1/2004 | Dock et al. | 175/107 |
| 2002/0096887 | A1 | 7/2002 | Schultz et al. | |
| 2006/0064972 | A1 | 3/2006 | Allen | |

FOREIGN PATENT DOCUMENTS

| | | |
|---|---|---|
| GB | 044822 | 10/1980 |
| WO | WO 02/057589 | 7/2002 |

OTHER PUBLICATIONS

U.K. Search Report for application No. GB 0419933.7.

(Continued)

*Primary Examiner*—Kenneth Thompson
(74) *Attorney, Agent, or Firm*—Marlin R. Smith

(57) ABSTRACT

An enhanced electrical power generating system. In a described embodiment, an electrical power generating system for use in a subterranean well includes a flow passage formed through a tubular string in the well, a flow region in communication with, and laterally offset relative to, the flow passage, an electrical power generator operative in response to flow of fluid through the flow region and multiple flow restrictors in the flow passage. The flow restrictors are operative to influence at least a portion of the fluid to flow from the flow passage through the flow region.

64 Claims, 8 Drawing Sheets

OTHER PUBLICATIONS

Journal of Hydraulic Engineering, "Sediment Management with Submerged Vanes. 1: Theory", vol. 117, dated Mar. 1991.
McGraw-Hill, Inc., "Fluid Mechanics", dated 1979, 1986.
Office Action dated Aug. 28, 2006 for U.S. Appl. No. 10/826,952.
Examination Report for UK application serial No. GB0419933.7.

* cited by examiner

BOREHOLE DISCONTINUITIES FOR ENHANCED POWER GENERATION

BACKGROUND

The present invention relates generally to operations performed and equipment utilized in conjunction with subterranean wells and, in an embodiment described herein, more particularly provides a downhole electrical power generator.

It is well known to use fluid flow through a tubular string in a well to generate electrical power. Various ways of accomplishing this goal have included positioning vibrating structures, impellers, etc. in a flow passage extending through the tubular string. Another concept involves positioning a generator in a side pocket, and then directing the fluid to flow through the generator in the side pocket.

Unfortunately, each of these prior methods substantially restricts access through the flow passage, for example, to convey well tools through the passage. Of course, structures such as impellers and vibrating members in the passage will obstruct the passage. Those systems which utilize a generator in a side pocket also use an obstruction in the passage to direct the fluid to flow toward the side pocket.

Therefore, for these reasons and others, it would be advantageous to provide a system which enhances electrical power generation due to fluid flow through a passage. In addition, it would be very desirable for such a system to provide for access of well tools through the passage.

SUMMARY

In carrying out the principles of the present invention, in accordance with an embodiment thereof, systems and apparatuses are provided which increase the level of power generation which may be achieved from a given rate of fluid flow through a tubular string in a well, but which also reduce or eliminate the problem of obstruction to well tool access. Other systems and apparatuses are also described herein which are not limited to electrical power generation or to use in a well.

Accordingly, in one aspect of the invention, an electrical power generating system for use in a subterranean well is provided. The system includes a flow passage formed through a tubular string in the well and a flow region in communication with, and laterally offset relative to, the flow passage. An electrical power generator is operative in response to flow of fluid through the flow region. Multiple flow restrictors in the flow passage influence at least a portion of the fluid to flow from the flow passage through the flow region.

Also provided in another aspect of the invention is an apparatus for redirecting fluid flow through the apparatus. The apparatus includes a flow passage extending in the apparatus, a flow region in communication with the flow passage, a tool operative in conjunction with fluid in the flow region and multiple flow restrictors in the flow passage. The flow restrictors are operative to influence at least a portion of the fluid to flow from the flow passage to the flow region.

Another apparatus for redirecting fluid flow therethrough is provided by the invention. The apparatus includes a flow passage extending in the apparatus, a flow region in communication with the flow passage on a lateral side of the flow passage and a tool operative in conjunction with fluid in the flow region. An intersection between the flow passage and the flow region is formed upstream of the tool. The intersection has a relatively smooth internal profile on the lateral side of the flow passage, thereby influencing the fluid to flow toward the flow region.

In still another aspect of the invention, an electrical power generating system is provided. The system includes a flow passage having a longitudinal axis and a flow rotating structure which influences fluid flowing through the flow passage to rotate about the longitudinal axis. A rotationally mounted device rotates in response to the fluid rotating about the longitudinal axis.

In a further aspect of the invention, an apparatus for redirecting fluid flow therethrough is provided. The apparatus includes a flow passage extending in the apparatus, the flow passage being configured for flow of fluid therethrough, and for well tool access therethrough. A flow region is in communication with the flow passage on a lateral side of the flow passage. Multiple flow restrictors in the flow passage influence the fluid to flow away from the flow passage.

In yet another aspect of the invention, an apparatus for redirecting fluid flow therethrough is provided. The apparatus includes a flow passage extending in the apparatus, the flow passage being configured for flow of fluid therethrough, and for well tool access therethrough. A flow region is in communication with the flow passage on a lateral side of the flow passage. A flow restricting device influences an increasing proportion of the fluid to flow through the flow region, instead of through the flow passage, as a rate of fluid flow through the apparatus increases.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1A:
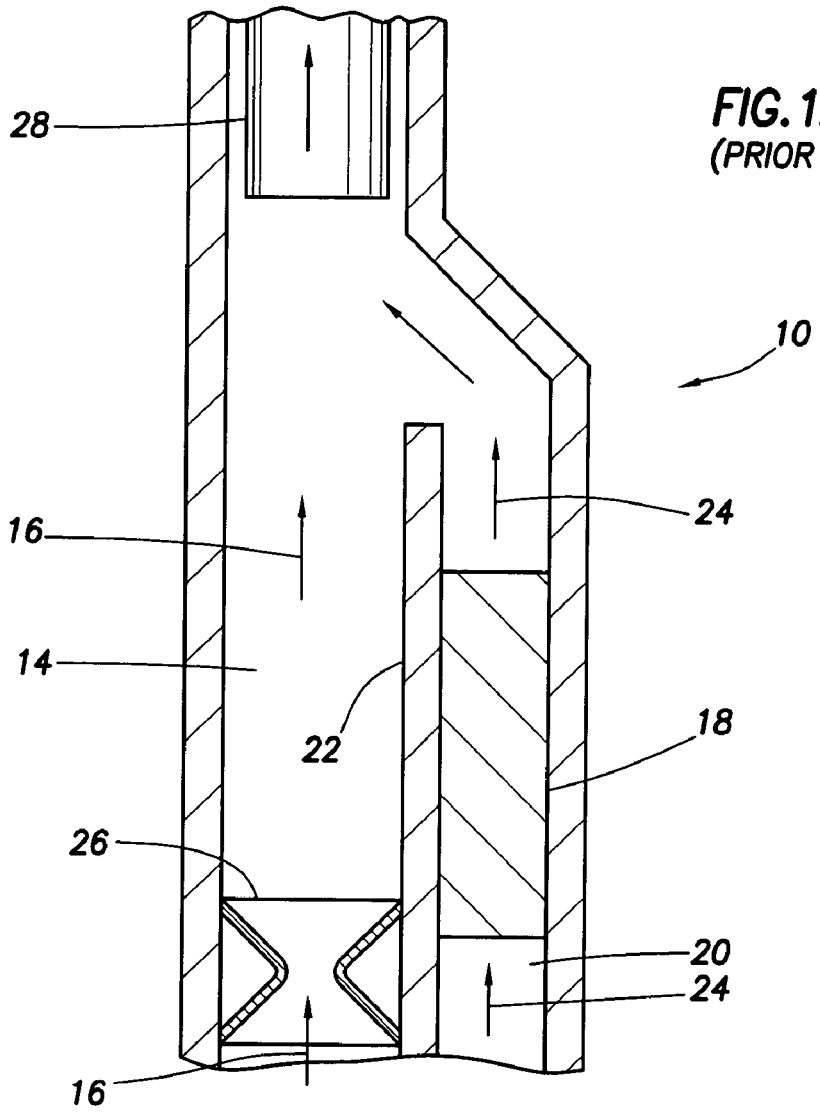
FIG. 1A (PRIOR ART)
FIGS. 1A & B are schematic cross-sectional views of prior art electrical power generating apparatuses.

Illustrated in FIGS. 1A & B are prior art apparatuses 10, 12. These apparatuses 10, 12 are more completely described in U.S. Pat. No. 5,839,508, the entire disclosure of which is incorporated herein by this reference.

The apparatus 10 includes a flow passage 14 through which fluid flows (indicated by arrows 16) during operation of a subterranean well. An electrical power generator 18 is positioned in another flow passage 20 which is laterally offset from the flow passage 14. The passages 16, 20 are separated by a wall 22 therebetween.

The generator 18 generates electrical power in response to a flow of the fluid (indicated by arrows 24) through the passage 20. In order to increase the flow of fluid 24 through the passage 20 to thereby increase the level of electrical power generated, a flow restrictor 26 is positioned in the passage 14. By restricting the flow of fluid 16 through the passage 14, more of the fluid 24 is induced to flow through the other passage 20.

However, an undesirable consequence of using the restrictor 26 is that it prevents, or at least substantially hinders, the conveyance of a well tool 28, such as a logging tool, perforating gun, etc., through the passage 14. This is so, even when the fluid 16 is not flowing through the passage 14 and the presence of the restrictor 26 is, thus, not needed in the passage since electrical power is not being generated.

Figure 1B:
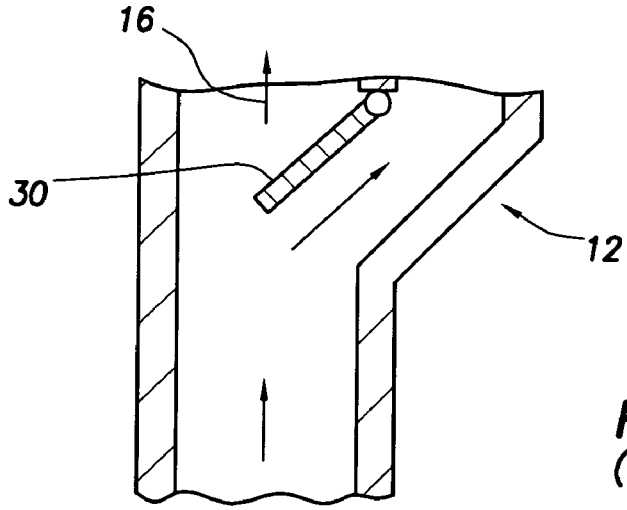
FIG. 1B (PRIOR ART)

The apparatus 12 has similar undesirable features. The apparatus 12 is illustrated in FIG. 1B in partial cross-section adjacent to FIG. 1A, since the apparatuses 10, 12 each include the passages 14, 20, the wall 22 and the generator 18. However, the apparatus 12 does not use the restrictor 26.

Instead, the apparatus 12 includes a vane or diverter 30. The vane 30 operates to restrict fluid flow 16 through the passage 14 and increase fluid flow 24 through the passage 20. As with the restrictor 26 described above, the vane 30 substantially hinders or prevents conveyance of the well tool 28 through the passage 14.

Figure 2:
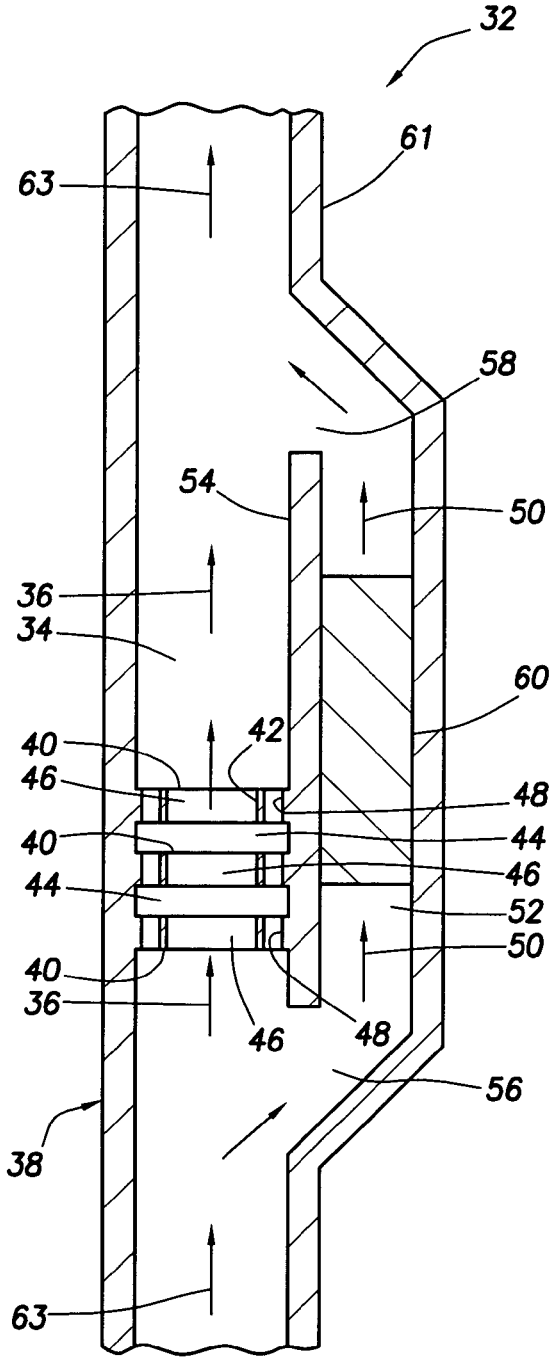
FIG. 2 is a schematic cross-sectional view of a first system embodying principles of the present invention.

Representatively illustrated in FIG. 2 is an electrical power generating system 32 which embodies principles of the present invention. In the following description of the system 32 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

It has been found by the present inventors that, when it is desired to restrict fluid flow (indicated by arrows 36) through a passage 34 in an apparatus 38, and also permit conveyance of a well tool (such as the well tool 28) through the passage, substantially greater access may be provided through the passage by using multiple spaced apart flow restrictors 40 in the passage, instead of a single large obstruction. In this way, a minimum internal dimension 42 of the flow restrictors 40 can be made substantially larger than that which must be used with a single large obstruction.

In the embodiment depicted in FIG. 2, one reason for this advantage over the prior art is that the restrictors 40 are configured to form alternating regions of fluid expansion 44 (between the restrictors) and fluid contraction 46 (within the minimum dimension 42). This alternating expansion and contraction of the fluid 36 increases friction in the flow, thereby enhancing the restriction to fluid flow through the passage 34. Preferably, the longitudinal length of each expansion region 44 is greater than the radius change between the expansion and contraction regions 44, 46, but less than four times that radius change. However, other expansion region lengths may be used, without departing from the principles of the invention.

As depicted in FIG. 2, the restrictors 40 are annular-shaped rings which are longitudinally spaced apart relative to the passage 34. The restrictors 40 each have a generally rectangular cross-section. Although only three such rings 40 are illustrated in FIG. 2, approximately ten rings are presently preferred, and any number may be used in keeping with the principles of the invention.

In addition, openings 48 are formed through the restrictors 40 to further increase the friction due to flow through the restrictors. Such openings may be formed through any of the other flow restrictors described below, to produce increased flow resistance through the passage 34, without increased obstruction in the passage.

Using these principles, the fluid flow 36 through the passage 34 is substantially restricted without substantially hindering the conveyance of a well tool through the passage. That is, the minimum internal dimension 42 of the restrictors 40 can be made substantially larger than if a single obstruction were used in the passage 34.

By restricting the fluid flow 36 through the passage 34, fluid flow (indicated by arrows 50) is increased in a flow passage or region 52 which is laterally offset relative to the passage 34. The passage 52 is depicted in FIG. 2 as being separated from the passage 34 by a wall or other flow barrier 54 therebetween. At a lower end of the wall 54 is an inlet 56 to the passage 52, and at an upper end of the wall is an outlet 58 for the fluid 50 to flow between the passages 34, 52.

However, it should be clearly understood that the specific details of the construction of the apparatus 38 described herein are not necessary in keeping with the principles of the invention. Several different configurations and alternative ways of accomplishing an objective of redirecting flow in an apparatus are described below, in part to demonstrate that the principles of the invention are not limited to any specific embodiment, but instead permit a wide variety of configurations. For example, the flow region 52 could be laterally offset relative to the passage 34 by forming the region 52 as an annular passage positioned about the passage 34.

A tool 60 is schematically illustrated in the passage 52 in FIG. 2. The tool 60 may be an electrical power generator, such as any of the generators described in the incorporated U.S. Pat. No. 5,839,508, including but not limited to generators which use turbines, spinners, vibrating or oscillating members, piezoelectrics, magneto-restrictive elements, etc., and which use flow, pressure and/or pressure pulses as a means of actuating the generators. Additional electrical power generators are described in U.S. Pat. No. 6,504,258, U.S. Patent Application Publication No. 2002/0096887, and in International Publication No. WO 02/057,589, the entire disclosures of which are incorporated herein by this reference.

However, it is not necessary for the tool 60 to be an electrical power generator. The tool 60 could instead be, for example, a sensor, such as a pressure, temperature or other fluid property or identity sensor, or the tool could be a fluid sampler, etc. Thus, it will be appreciated that the tool 60 may be any type of tool operative in conjunction with the fluid 50 in the passage 52, and it is not necessary for the fluid to actually flow through the tool for its operation.

The apparatus 38 as depicted in FIG. 2 is conveyed into a well attached to a tubular string 61, such as a drill string, production tubing string, coiled tubing string, etc. Fluid flow through the tubular string 61 (indicated by arrows 63) is used in conjunction with operation of the tool 60. However, it should be clearly understood that it is not necessary for the system 32 to include attachment of the apparatus 38 to, or conveyance with, the tubular string 61, nor is it necessary for the apparatus to be positioned in a well. For example, the apparatus 38 could be interconnected in a pipeline or other type of fluid conduit.

Figure 3:
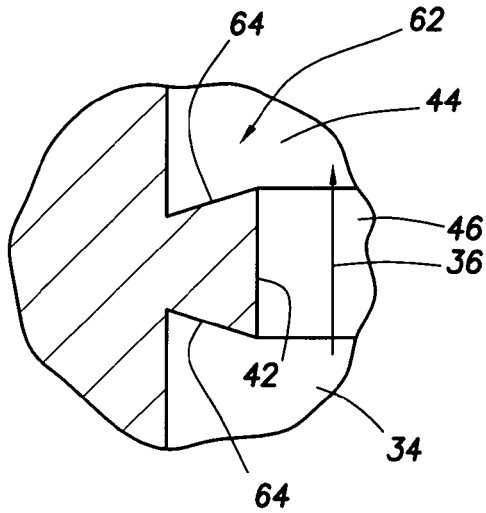
FIG. 3 is an enlarged cross-sectional view of an alternate flow restrictor which may be used in the system of FIG. 2.

Referring additionally now to FIG. 3, an alternative flow restrictor 62 is representatively illustrated. The restrictor 62 may be used in place of, or in addition to, any or all of the restrictors 40 in the apparatus 38.

The restrictor 62 is generally annular-shaped and extends inwardly into the passage 34, similar to the projections 40. However, the restrictor 62 has a generally dovetail-shaped cross-section as depicted in FIG. 3. That is, the restrictor 62 has longitudinally opposed (relative to the passage 34) laterally inclined faces 64 exposed to the fluid flow 36 in the passage 34. It is believed that the restrictor 62 will provide greater resistance to fluid flow 36 therethrough, in that greater friction is generated in the fluid as it flows through the restrictor.

The various restrictors 40, 62 described herein demonstrate that a specific restrictor configuration is not necessary in keeping with the principles of the invention. A flow restrictor may have any shape, position, etc. For example, a flow restrictor may have a generally semi-circular or wedge-shaped cross-section. As further examples of flow restrictors described below demonstrate, it is also not necessary for a flow restrictor to be annular-shaped or to extend continuously circumferentially about a flow passage.

Figure 4:
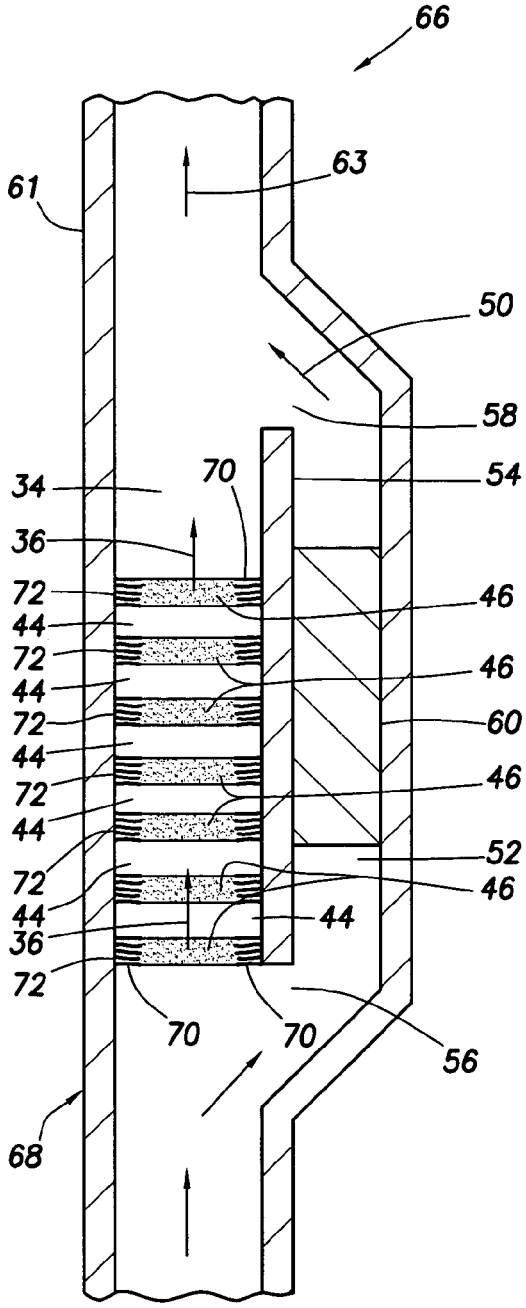
FIG. 4 is a schematic cross-sectional view of a second system embodying principles of the present invention.

Referring additionally now to FIG. 4, another embodiment of a system 66 incorporating principles of the invention is representatively illustrated. The system 66 includes an apparatus 68 which is similar in many respects to the apparatus 38 described above. Accordingly, elements of the apparatus 68 which are similar to those described above are indicated in FIG. 4 using the same reference numbers.

One significant difference between the apparatuses 38, 68 is that, instead of the rings 40, the apparatus 68 includes multiple whiskers 70 projecting inwardly into the passage 34. As used herein, the term "whisker" is used to indicate an elongated relatively thin flexible member.

As depicted in FIG. 4, each of the whiskers 70 is secured at one end, an opposite end of the whisker projecting into the passage 34 and being deflectable by a well tool conveyed through the passage. In this manner, the whiskers 70 do not significantly hinder tool conveyance through the passage 34. The whiskers 70 may be made of a shape memory alloy, since these are known to have superior erosion resistance, high strength and a high strain-to-failure limit.

Although each of the whiskers 70 is relatively small and easily deflected, the large number of the whiskers results in a substantial restriction to the fluid flow 36 through the passage 34. In addition, to form the alternating fluid expansion regions 44 and contraction regions 46, the whiskers 70 are grouped into separate circumferentially distributed sets or bands 72 of the whiskers. The fluid contraction regions 46 are within the annular bands 72, while the expansion regions 44 are between the bands. As described above, the use of the alternating fluid expansion and contraction regions 44, 46 increases the resistance to fluid flow through the passage 34.

Figure 5:
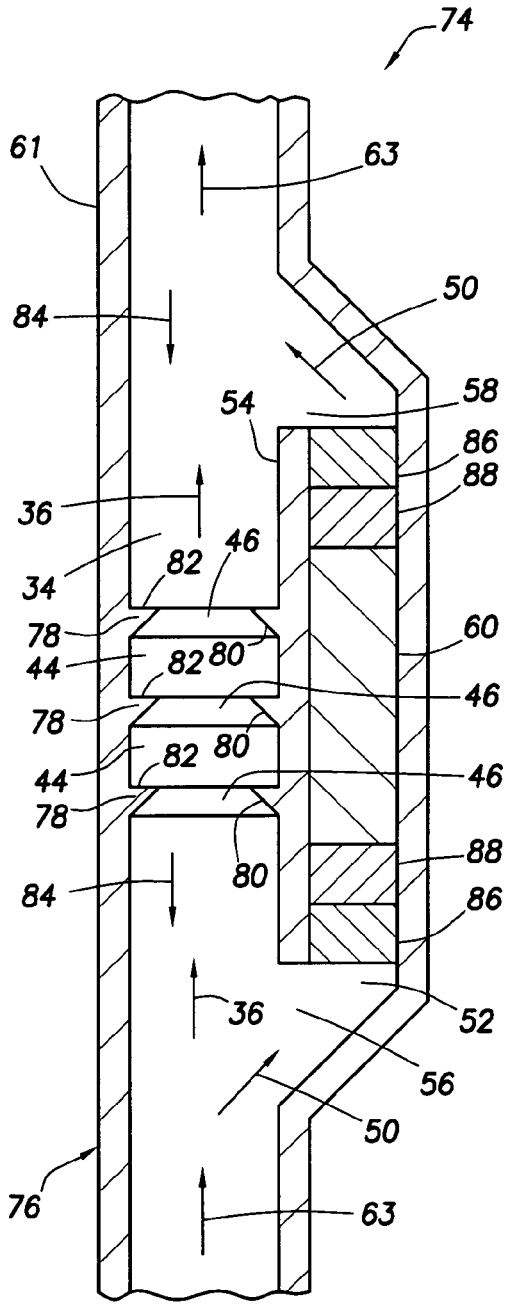
FIG. 5 is a schematic cross-sectional view of a third system embodying principles of the present invention.

Referring additionally now to FIG. 5, another system 74 incorporating principles of the invention is representatively illustrated. The system 74 includes an apparatus 76 which is similar in many respects to the apparatus 38 described above. Accordingly, elements of the apparatus 76 which are similar to those described above are indicated in FIG. 5 using the same reference numbers.

The system 74 demonstrates another manner in which resistance to fluid flow 36 through the passage 34 may be achieved, without significantly obstructing the passage. Specifically, the apparatus 76 includes multiple annular-shaped flow restrictors 78 longitudinally spaced apart relative to the passage 34 and projecting inwardly into the passage. One significant difference between the restrictors 78 of the apparatus 76 and the restrictors 40 of the apparatus 38 described above is that the restrictors 78 have a generally wedge-shaped cross-section, instead of a rectangular cross-section.

Arranged as depicted in FIG. 5, a laterally inclined face 80 of each of the restrictors 78 faces in an upstream direction relative to the fluid flow 36 through the passage 34. Thus, the fluid contraction regions 46 are encountered by the fluid flow 36 relatively gradually. In comparison, the fluid expansion regions 44 are encountered rather abruptly by the fluid flow 36, due to an opposing upper face 82 of each of the restrictors 78 being formed generally perpendicular to the fluid flow.

Thus, expansion of the fluid flow 36 is sudden, generating substantial friction in the fluid flow, while contraction of the fluid flow is relatively gradual. It is believed that greater resistance to fluid flow is generated by sudden expansion than by sudden contraction of the fluid flow. Therefore, if it is desired to produce an increased resistance to the fluid flow 36, the inclined faces 80 of the flow restrictors 78 should be facing in the upstream direction. If, however, a reduced level of flow resistance is desired, the inclined faces 80 may face in the downstream direction.

Another significant benefit is achieved by use of the flow restrictors 78. At times it may be desired to inject fluid into a well, rather than produce fluid from the well. This occurs, for example, in steam injection wells, in well treatment and stimulation operations, etc. Furthermore, it may be desired to both inject fluid into the well at some times, and produce fluid from the well at other times, such as in injection/production wells which utilize "huff and puff" steam injection, or wells which are stimulated by fracturing prior to production, etc. In FIG. 5, fluid flow through the passage 34 in a direction opposite to the fluid flow 36 is indicated by arrows 84.

In these situations it may be desirable to significantly restrict the fluid flow 36 in one direction through the passage, while permitting relatively unrestricted, or at least less restricted, fluid flow 84 in the opposite direction. For example, during fracturing operations, it is generally desired to have a relatively unrestricted flow of fluids through the tubular string 61, but during production it may be desired to restrict the fluid flow 36 through the passage 34 in order to direct a greater proportion of the fluid to the passage 52 (for long-term production of electrical power, sensing fluid properties, fluid sampling, etc.).

It will be readily appreciated from the above description that the flow restrictors 78 provide greater resistance to the fluid flow 36 (in an upward direction through the passage 34 as depicted in FIG. 5), and provides lesser resistance to the fluid flow 84 (in a downward direction as depicted in FIG. 5). Thus, in the situation discussed above, the resistance to the fluid flow 84 during fracturing operations will be less than the resistance to the fluid flow 36 during production. Of course, the opposite would be true if the fluids 36, 84 were flowed in the opposite directions, respectively, or if the arrangement of the flow restrictors 78 were reversed, i.e., with the inclined faces 80 facing in the upstream direction relative to the fluid flow 84.

In order to prevent debris or other unwanted matter from damaging or accumulating in or about the tool 60, the apparatus 76 includes filters 86 positioned on opposite sides of the tool. For example, if the apparatus 76 is used in a fracturing or gravel packing operation, the filters 86 may operate to exclude proppant or gravel from coming into contact with the tool 60. Also illustrated in FIG. 5 are sensors 88 positioned on opposite sides of the tool 60, for example, to monitor input and output characteristics of the tool's operation. These sensors 88 are also protected by the filters 86.

Figure 6:
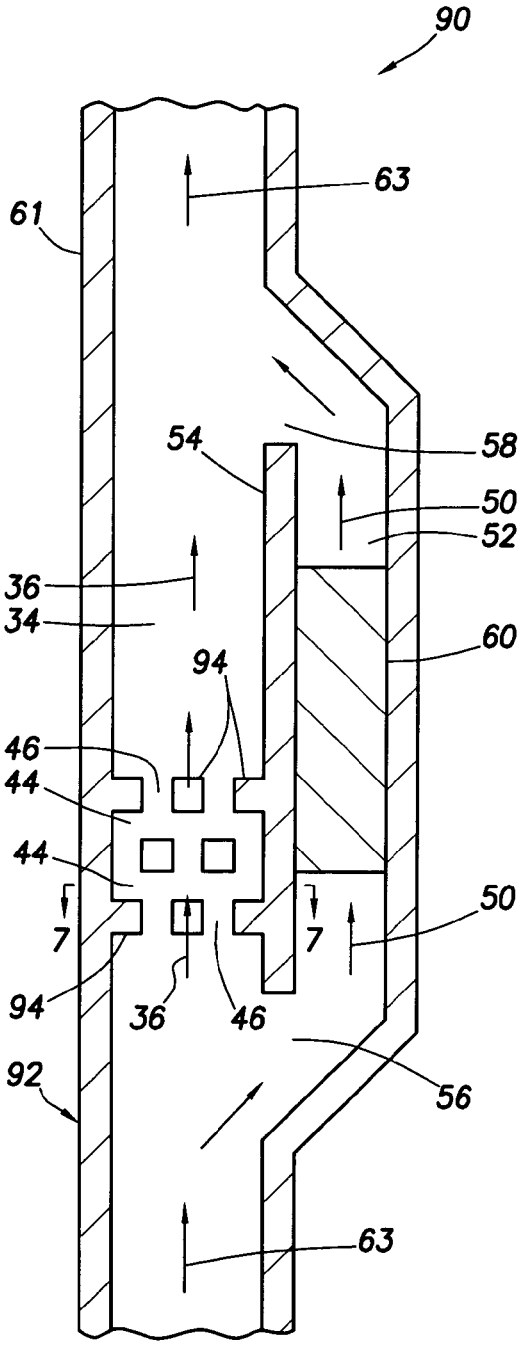
FIG. 6 is a schematic cross-sectional view of a fourth system embodying principles of the present invention.

Representatively illustrated in FIG. 6 is another system go embodying principles of the present invention. The system go includes an apparatus 92 which is similar in many respects to the apparatus 38 described above. Accordingly, elements of the apparatus 92 which are similar to those described above are indicated in FIG. 6 using the same reference numbers.

The apparatus 92 differs in at least one substantial respect from the other apparatuses described above in that it includes flow restrictors 94 which are not configured to be circumferentially continuous. Instead, the restrictors 94 are individual circumferentially and longitudinally spaced apart (relative to the passage 34) projections extending inwardly into the passage. As depicted in FIG. 6, each of the projections 94 has a generally rectangular cross-section and is in the shape of a square-sided block or rectangular prism.

However, other shapes may be used for the projections 94 in keeping with the principles of the invention. For example, the projections 94 may have a semi-circular, triangular or otherwise-shaped cross-section, and the projections may have shapes such as tetrahedron, pyramid, hemisphere, or other shapes. Furthermore, it is not necessary for all of the projections 94 to have the same shape.

Note that fluid 36 flowing between two of the projections 94 will preferably impinge on another one of the projections. This increases the resistance to flow of the fluid 36 through the passage 34, without further obstructing the passage. Note also, that by arranging the projections 94 about the circumference of the passage 34, the fluid contraction regions 46 are formed in the passage, and by longitudinally spacing apart the circumferentially distributed projections, the fluid expansion regions 44 are formed.

Figure 7:
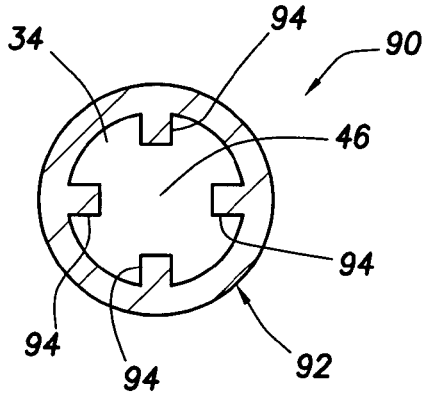
FIG. 7 is a cross-sectional view of the fourth system, taken along line 7-7 of FIG. 6.

A more complete understanding of how the projections 94 are configured in the passage 34 may be had from a consideration of the cross-sectional view of the passage as depicted in FIG. 7. In this view it may be seen that the projections 94 are preferably evenly spaced about the circumference of the passage 34, although this spacing is not necessary in keeping with the principles of the invention. In this view it may also be seen how the presence of the projections 94 in the passage creates the fluid contraction region 46 therein.

Figure 8:
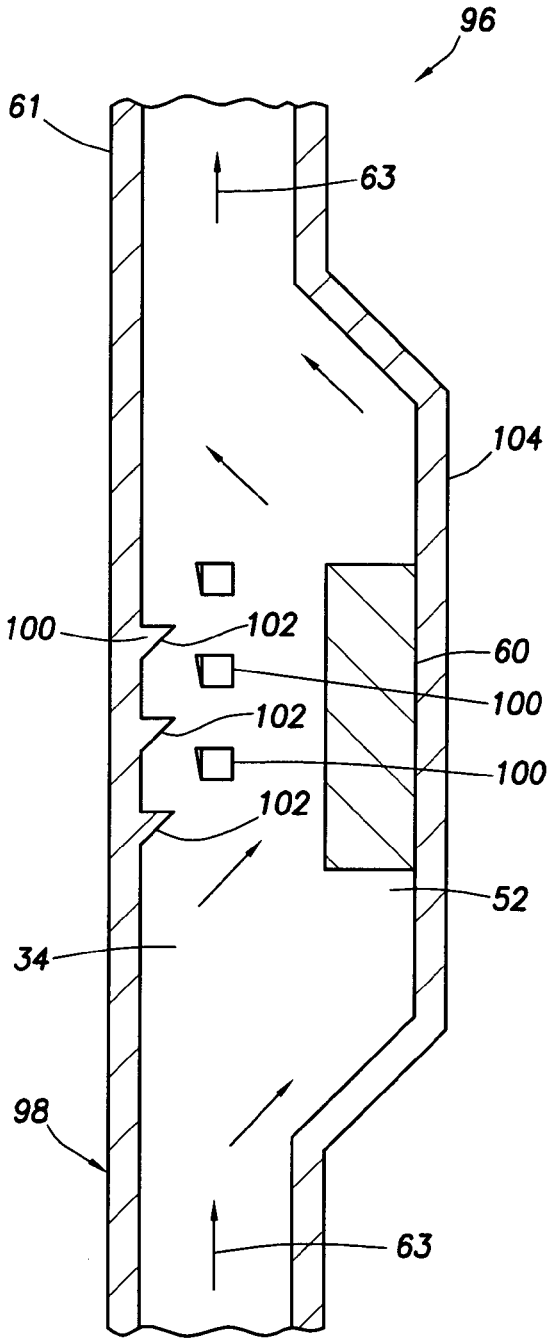
FIG. 8 is a schematic cross-sectional view of a fifth system embodying principles of the present invention.

Referring additionally now to FIG. 8, another system 96 embodying principles of the invention is representatively illustrated. The system 96 includes an apparatus 98 which is similar in many respects to the apparatus 38 described above. Accordingly, elements of the apparatus 98 which are similar to those described above are indicated in FIG. 8 using the same reference numbers.

The apparatus 98 is also similar in many respects to the apparatus 92 described above, in that it includes projections 100 extending inwardly into the flow passage 34. However, the projections 100 each have a generally wedge-shaped cross-section, with a laterally inclined face 102 facing in an upstream direction. As described above, flow over the inclined faces 102 causes a gradual contraction of the flow, and then an abrupt expansion, which increases the resistance to flow through the passage 34.

In addition, the projections 100 are circumferentially distributed and longitudinally spaced apart, so that flow between two of the projections impinges on another of the projections. However, note that the projections 100 do not completely encircle the passage 34. This is due to the fact that, in this embodiment, there is no wall 54 between the passage 34 and the flow region 52. Instead, the flow region 52 may be considered a lateral extension of the flow passage 34, the flow region being laterally recessed into a sidewall 104 of the passage.

Thus, one of the features of the apparatus 98 is that it operates to influence the fluid 63 to flow toward the tool 60 (i.e., toward the region 52). Of course, the fluid 63 would fill the region 52, even without providing the projections 100 in the passage 34, but in situations in which the tool 60 operates in response to not only the presence of the fluid, but also the rate of flow of the fluid (such as when the tool is an electrical power generator), the projections operate to influence the fluid to flow away from the passage 34, and flow toward the region 52 and the tool 60 therein, whereby a greater proportion of the fluid flow at an increased flow rate is in the region 52.

Figure 9:
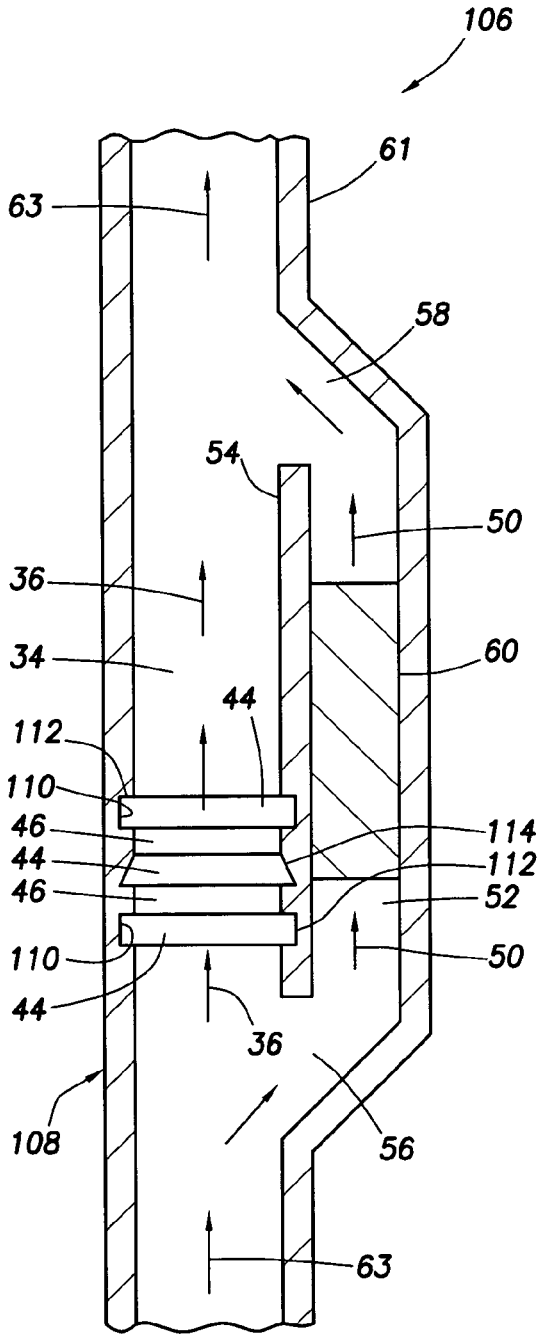
FIG. 9 is a schematic cross-sectional view of a sixth system embodying principles of the present invention.

Referring additionally now to FIG. 9, another system 106 embodying principles of the invention is representatively illustrated. The system 106 includes an apparatus 108 which is similar in many respects to the apparatus 38 described above. Accordingly, elements of the apparatus 108 which are similar to those described above are indicated in FIG. 9 using the same reference numbers.

The apparatus 108 differs in at least one substantial respect from the apparatus 38 in that, instead of the inwardly projecting flow restrictor rings 40 of the apparatus 38, the apparatus 108 includes a series of longitudinally spaced apart annular recesses 110. It will be readily appreciated that the recesses 110 present no obstruction to conveyance of tools or other equipment through the passage 34.

However, the recesses 110 do operate to resist fluid flow 36 therethrough, thereby influencing a greater proportion of the fluid to flow through the passage or region 52. This is due, at least in part, to the alternating flow expansion and contraction regions 44, 46 formed by the recesses 110. As described above, these expansion and contraction regions 44, 46 create friction in the fluid flow 36 through the passage 34.

As depicted in FIG. 9, outer ones of the recesses 110 each have a generally rectangular-shaped profile 112, but the profile could be otherwise shaped without departing from the principles of the invention. For example, the profile 112 could be generally wedge-shaped, with a laterally inclined face facing in an upstream direction relative to the fluid flow 36, so that a relatively gradual contraction region 46 is obtained at the inclined face, while an abrupt expansion region 44 is obtained as the fluid enters the profile. Such a wedge-shaped profile 114 is depicted between the outer rectangular-shaped profiles 112 in FIG. 9. Any shape profile may be used for the recesses 110 in keeping with the principles of the invention.

Figure 10:
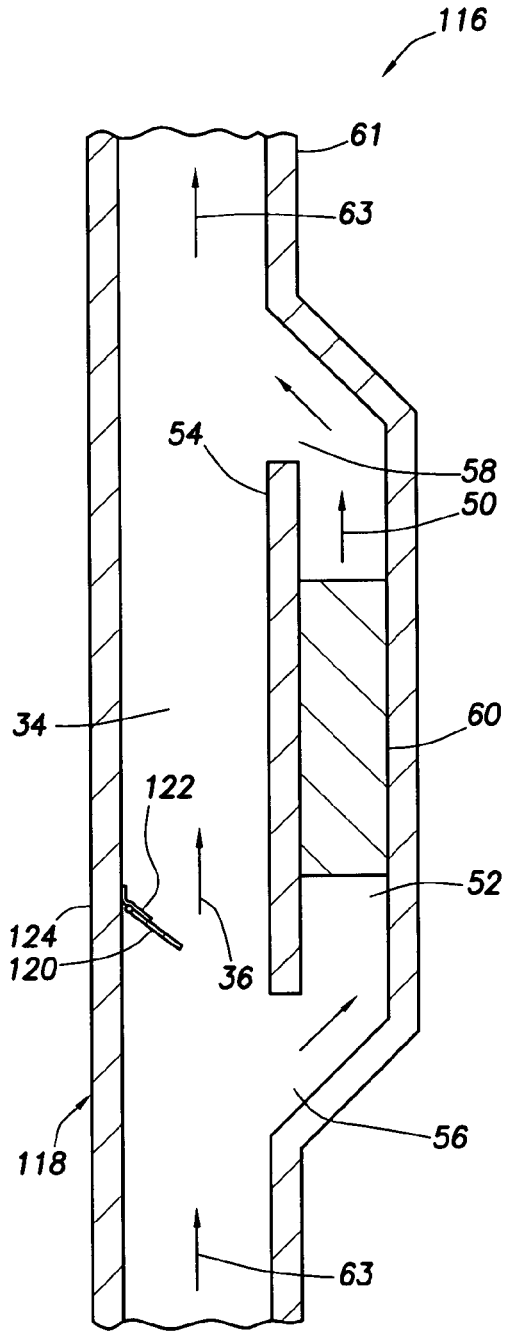
FIG. 10 is a schematic cross-sectional view of a seventh system embodying principles of the present invention.

Referring additionally now to FIG. 10, another system 116 embodying principles of the invention is representatively illustrated. The system 116 includes an apparatus 118 which is similar in many respects to the apparatus 38 described above. Accordingly, elements of the apparatus 118 which are similar to those described above are indicated in FIG. 10 using the same reference numbers.

One substantial difference between the apparatus 118 and the apparatus 38 (and most of the other apparatuses described above) is that, instead of using stationary flow restrictors, the apparatus 118 includes a flow restricting device 120, representatively a vane, which is pivotably mounted in the passage 34. A biasing device 122, representatively a torsion spring, biases the vane 120 to rotate to a position in which the passage 34 is more unobstructed or open to flow therethrough. Thus, when there is no fluid flow 36 through the passage 34, the vane 120 is pivoted to its most open position.

However, as fluid flow 36 through the passage 34 increases, the vane 120 is pivoted (by hydrodynamic forces due to the fluid flow) to increasingly restrict the flow of fluid through the passage. This causes an increasingly greater proportion of the fluid flow 63 to flow through the passage 52 instead of the passage 34. As fluid flow 36 through the passage 34 decreases, the spring 122 gradually overcomes the hydrodynamic forces, and the vane 120 is pivoted back to a more open position.

Although the vane 120 does at least partially obstruct the passage 34 when sufficient fluid flow 36 is present in the passage, access through the passage is typically not required when such fluid flow is present. That is, tools and equipment are not generally conveyed through a tubular string in a well while fluid is also being produced through the tubular string. Thus, the obstruction presented by the vane 120 while the passage 34 has fluid flow 36 therein will typically be of no consequence. Note also, that the vane 120 may be recessed into a sidewall 124 of the passage 34, so that it also presents no obstruction in the passage while there is no flow therethrough.

Figure 11:
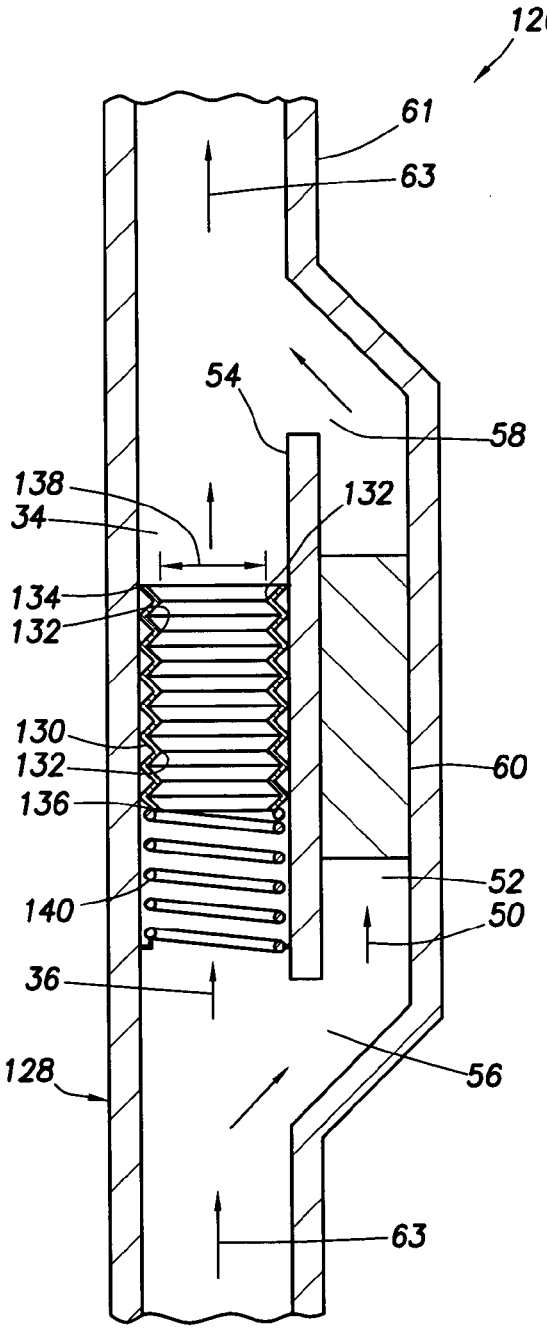
FIG. 11 is a schematic cross-sectional view of an eighth system embodying principles of the present invention.

Referring additionally now to FIG. 11, another system 126 is representatively illustrated. The system 126 includes an apparatus 128 which is similar in many respects to the apparatus 38 described above. Accordingly, elements of the apparatus 128 which are similar to those described above are indicated in FIG. 11 using the same reference numbers.

One substantial difference between the apparatuses 38, 128 is that, instead of using stationary flow restrictors 40, the apparatus 128 uses a longitudinally expandable bellows-shaped device 130. The fluid flow 36 passes through an interior of the device 130. Since the bellows device 130 is pleated, multiple flow restrictors 132 are formed therein due to the pleat shapes. Various pleat shapes may be used to form various configurations of flow expansion and contraction regions within the bellows device 130, so that a desired level of flow restriction through the device may be obtained.

Furthermore, the bellows device 130 is secured at a downstream end 134 in the passage 34, while an upstream end 136 of the bellows device is displace able in the passage. As the rate of fluid flow 36 through the passage 34 increases, hydrodynamic forces tend to bias the upstream end 136 to displace toward the downstream end 134, thereby longitudinally contracting the bellows device 130. This longitudinal contraction of the bellows device 130 causes a minimum internal dimension 138 of the device to decrease, thereby further increasing the resistance to fluid flow 36 therethrough.

A biasing device 140, representatively a spring, biases the upstream end 136 in a direction opposite to the biasing due to the hydrodynamic forces. Thus, as the rate of fluid flow 36 decreases (and the hydrodynamic forces biasing the upstream end 136 toward the downstream end 134 accordingly decrease), the spring 140 gradually overcomes the hydrodynamic forces and displaces the upstream end away from the downstream end, thereby elongating or expanding the bellows device 130. As the bellows device 130 elongates, the minimum internal dimension 138 increases.

Therefore, an increased rate of fluid flow 36 in the passage 34 results in an increased restriction to flow therethrough, influencing the fluid to flow more through the passage 52 and toward the tool 60. This is desirable during normal operations, such as well production. When the rate of fluid flow 36 decreases or ceases, the passage 34 is increasingly open, which is desirable for conveyance of tools and other equipment therethrough.

Figure 12:
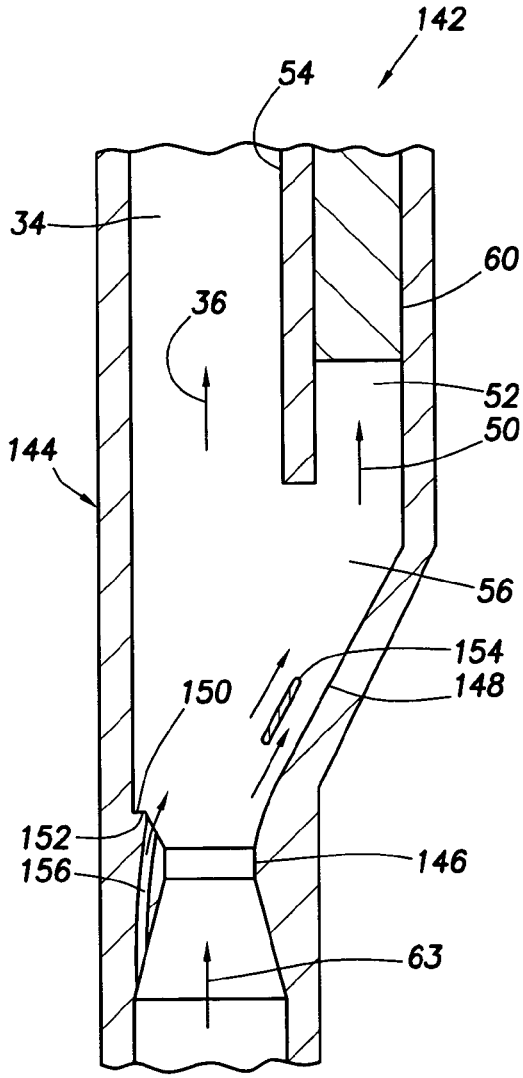
FIG. 12 is a schematic cross-sectional view of a ninth system embodying principles of the present invention.

Referring additionally now to FIG. 12, another system 142 embodying principles of the invention is representatively illustrated. The system 142 includes an apparatus 144 which is similar in many respects to the apparatus 38 described above. Accordingly, elements of the apparatus 144 which are similar to those described above are indicated in FIG. 12 using the same reference numbers.

Only a lower portion of the apparatus 144 is depicted in FIG. 12, it being understood that an upper portion thereof is substantially similar to that of the apparatus 38. One substantial difference in the apparatus 144 is that it includes no flow restrictor in the passage 34 downstream of the inlet 56 to the passage 52. Instead, a nozzle 146 is positioned upstream of the inlet 56. As will be readily appreciated by those skilled in the art, the nozzle 146 operates to contract the fluid flow 63 and accelerate the flow.

As the fluid 63 exits the nozzle 146, it encounters at an intersection between the passages 34, 52 a relatively smooth curved profile 148 on one lateral side and a discontinuity 150 on a profile 152 on an opposite lateral side. Due to the well-known Coanda effect, the fluid will tend to follow the smooth curved profile 148 and flow toward the passage 52, rather than toward the passage 34.

The discontinuity 150 on the profile 152 discourages the fluid 63 from flowing toward the passage 34 by increasing the resistance to flow through the passage 34 downstream of the intersection between the passages 34, 52. This increase in resistance is due, at least in part, to the abrupt flow expansion caused by the discontinuity 150.

To further influence the fluid 63 to flow toward the passage 52 and tool 60, a vane 154 may be positioned at the intersection between the passages 34, 52. Preferably, the vane 154 is positioned so that it does not obstruct conveyance of tools and other equipment through the passage 34.

To still further influence the fluid 63 to flow toward the passage 52 and tool 60, a bypass passage 156 may be used in conjunction with the nozzle 146. The bypass passage 156 directs fluid 63 from upstream of the nozzle 146 to impinge laterally on the fluid exiting the nozzle. This impingement laterally deflects the fluid 63 downstream of the nozzle 146, so that it flows toward the passage 52.

Figure 13:
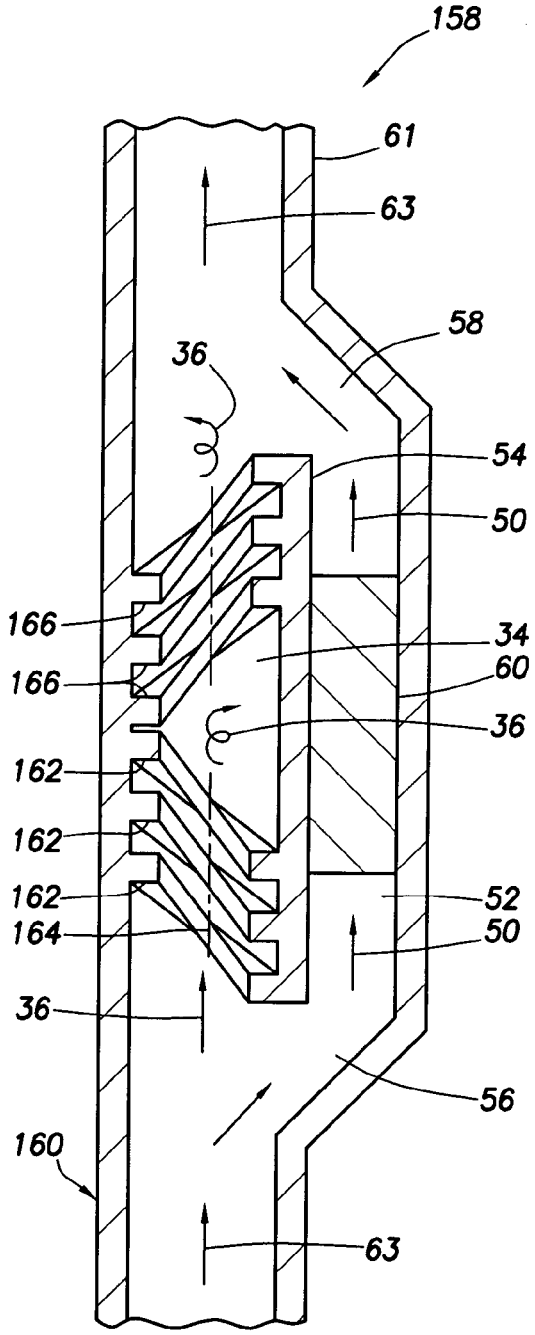
FIG. 13 is a schematic cross-sectional view of a tenth system embodying principles of the present invention.

Referring additionally now to FIG. 13, another system 158 embodying principles of the invention is representatively illustrated. The system 158 includes an apparatus 160 which is similar in many respects to the apparatus 38 described above. Accordingly, elements of the apparatus 160 which are similar to those described above are indicated in FIG. 13 using the same reference numbers.

One substantial difference in the apparatus 160 is that, instead of the flow restrictors 40 which extend circularly about the passage 34, the apparatus 160 includes flow restrictors 162 which extend helically about the passage. The flow restrictors 162 are depicted in FIG. 13 as having a generally rectangular cross-section, but other shapes, such as wedge shapes, may be used in keeping with the principles of the invention. Note also, that the flow restrictors 162 are longitudinally spaced apart, so that alternating flow contraction and expansion regions are formed by the flow restrictors, thereby increasing a resistance to fluid flow 36 through the passage 34 and influencing the fluid 63 to flow through the passage 52, instead of through the passage 34.

As the fluid 36 flows through the restrictors 162, the helical shape of the restrictors influences the fluid to rotate about a longitudinal axis 164 of the passage 34. This fluid rotation further increases the resistance to fluid flow 36 through the passage, thereby further influencing a greater proportion of the fluid 63 to flow through the passage 52, instead of through the passage 34.

To further increase the resistance to fluid flow 36 through the passage 34, the longitudinal spacings between the flow restrictors may be varied, so that there are multiple different spacings therebetween, the pitches of the flow restrictors may be different and/or the flow restrictors may have multiple different sizes (e.g., different thicknesses, etc.). These alternatives may be utilized without further obstructing the flow passage 34.

At this point it should be understood that the use of helically configured flow restrictors is not limited to the configuration depicted in FIG. 13. Indeed, any of the flow restrictors 40, 62, 72, 78, 94, 100, 110, 132 described above may also be helically configured or arranged in keeping with the principles of the invention. In each of these cases, such helical configuration or arrangement of the flow restrictors will preferably function to increase the restriction to flow therethrough, and without causing any further obstruction of the passage 34.

The apparatus 160 also includes additional flow restrictors 166, similar to the flow restrictors 162, in the passage 34. However, the restrictors 166 are configured to cause rotation of the fluid flow 36 in a direction opposite to that caused by the restrictors 162. That is, the flow restrictors 166 are helically configured about the longitudinal axis 164 oppositely to that of the restrictors 162.

Thus, the fluid 36 is first influenced to rotate about the axis 164 in one direction by the restrictors 162, and then influenced to rotate about the axis in an opposite direction by the restrictors 166. This rotation and counter-rotation of the fluid 36 further increases the resistance to flow through the passage 34, and thereby further influences the fluid 63 to flow through the passage 52, without increasingly obstructing the passage 34.

Figure 14:
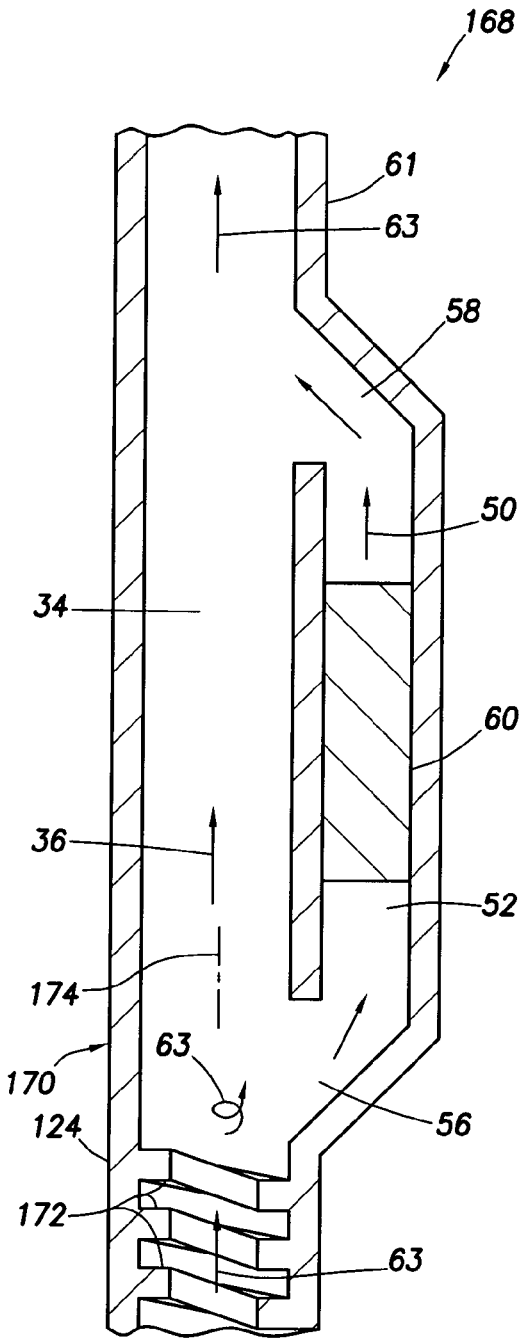
FIG. 14 is a schematic cross-sectional view of an eleventh system embodying principles of the present invention.

Referring additionally now to FIG. 14, another system 168 embodying principles of the invention is representatively illustrated. The system 168 includes an apparatus 170 which is similar in many respects to the apparatus 38 described above. Accordingly, elements of the apparatus 170 which are similar to those described above are indicated in FIG. 14 using the same reference numbers.

As with the system 142 described above, the system 168 as depicted in FIG. 14 does not utilize any flow restrictors in the passage 34 downstream of the inlet 56 to influence the fluid 63 to flow through the passage 52. Instead, the fluid 63 is influenced to flow toward the inlet 56 to the passage 52 using flow rotation inducing helically configured restrictors 172 upstream of the inlet.

Note that it is not necessary for the restrictors 172 to restrict flow therethrough, although normally that would be the case due to the inducement of rotation in the fluid 63 and alternating flow expansion and contraction regions formed by the restrictors depicted in FIG. 14. It is also not necessary for the restrictors 172 to be projections which might hinder tool conveyance therethrough, since the restrictors could, for example, be helically configured recesses such as the recesses 110.

It will be readily appreciated by those skilled in the art that when the fluid 63 is rotated about a longitudinal axis 174 of the apparatus 170, an increased flow rate will be experienced in the fluid as the distance from the axis increases. That is, at a larger radius the fluid 63 flows at a faster rate. Thus, when the rotating fluid 63 reaches the inlet 56 to the passage 52, the fluid 63 will flow at a faster rate into the passage 52 than if the fluid had not been rotating about the axis 174. In this manner, the proportion of the fluid flowing into the passage 52, rather than into the passage 34, is increased.

Figure 15:
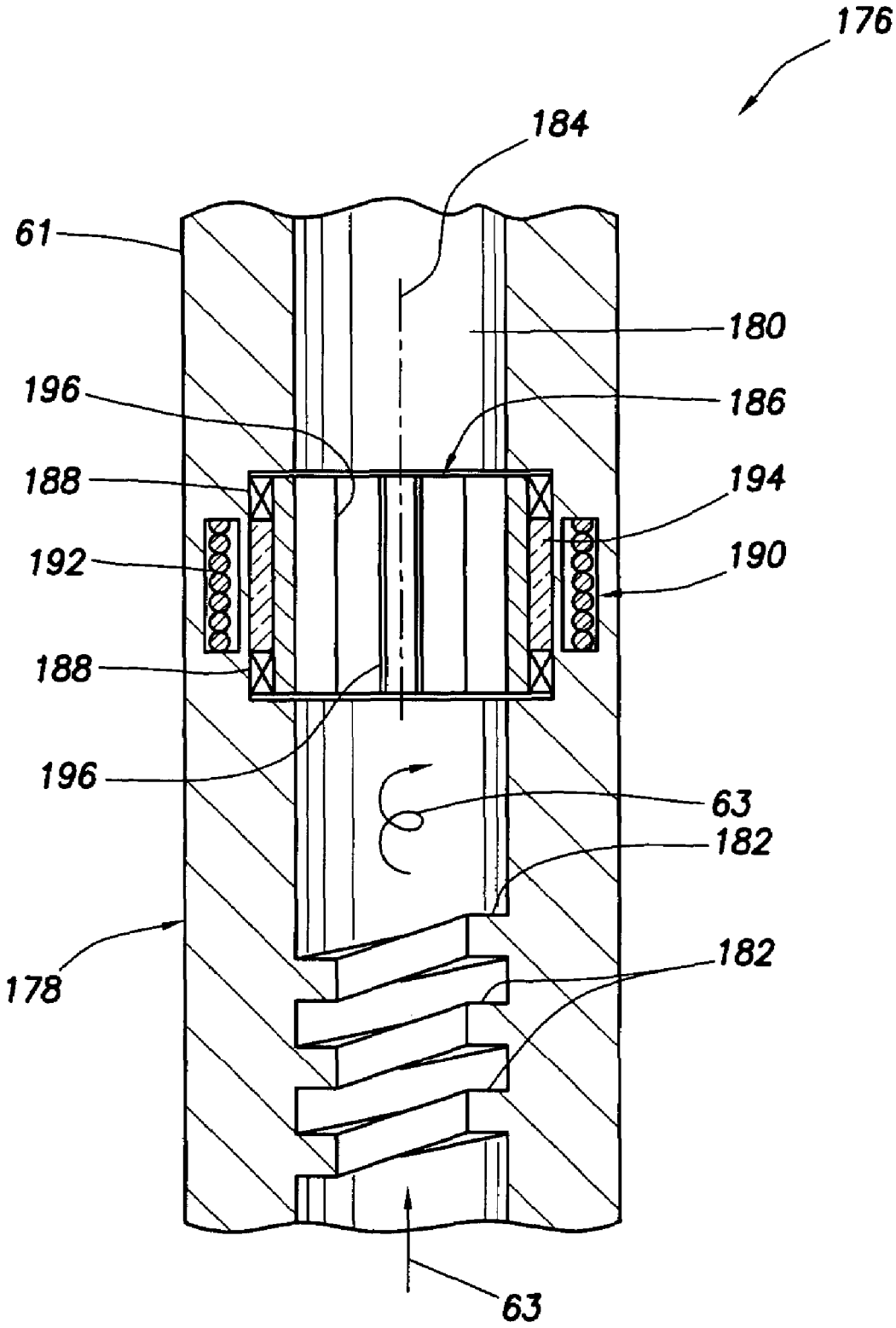
FIG. 15 is a schematic cross-sectional view of a twelfth system embodying principles of the present invention.

Referring additionally now to FIG. 15, another system 176 embodying principles of the invention is representatively illustrated. The system 176 includes an apparatus 178 which is substantially different from the previously described apparatuses at least in part in that only a single flow passage 180 is formed through the apparatus. However, other elements of the apparatus 178 which are similar to those previously described are indicated in FIG. 15 using the same reference numbers.

The apparatus 178 includes helically configured flow rotating structures 182 which influence the fluid 63 to rotate about a longitudinal axis 184 of the passage 180. The structures 182 will be recognized as being substantially similar to the helically configured flow restrictors 172 described above, in that they project inwardly into the passage 180. However, it should be understood that it is not necessary for the structures 182 to be similar to the restrictors 172, nor is it necessary for either of the apparatuses 168, 176 to include restrictions to flow therethrough at all.

Instead, the restrictors and structures 172, 182 are utilized to induce rotation in the fluid 63, without necessarily also restricting flow therethrough. Any structure which induces rotation in the fluid 63 may be used in place of the restrictors and structures 172, 182, without departing from the principles of the invention.

As depicted in FIG. 15, the fluid 63 rotates about the axis 184 downstream of the structures 182. Preferably, the structures 182 influence the fluid 63 to flow toward an outer periphery of the passage 180 as the fluid rotates. As discussed above, fluid rotating about a longitudinal axis of a passage will flow at a faster rate as the distance from the longitudinal axis of the passage increases.

Also positioned downstream of the structures 182 and exposed to the rotating fluid 63 is a rotationally mounted device 186, for example, rotatably mounted on bearings 188 at either end of the device. The device 186 is configured so that it is positioned about an outer periphery of the passage 180, the passage extending through the device. Thus, the device 186 does not significantly obstruct conveyance of well tools or other equipment through the apparatus 178.

The device 186 is connected to an electrical power generator 190, which includes a stationary coil 192 outwardly overlying a magnet 194 attached to the device. As will be readily understood by those skill in the art, electrical power is generated by the generator 190 when the magnet 194 is displaced relative to the coil 192.

The device 186 includes a series of circumferentially distributed vanes 196. As depicted in FIG. 15, the vanes 196 extend generally longitudinally on the device 186, although the vanes could be inclined relative to the axis 184, if desired. When the rotating fluid 63 impinges on the vanes 196, the device 186 is caused to rotate. Rotation of the device 186 causes rotation of the magnet 194 within the coil 192, thereby producing electrical power from the generator 190.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, any of the projections, restrictors or structures described above which extend into a passage may be made of a flexible material or may otherwise be deflectable, in order to permit easier conveyance of well tools or other equipment through the passage. Accordingly, the foregoing detailed description is to be clearly understood as being given by way of illustration and example only, the spirit and scope of the present invention being limited solely by the appended claims and their equivalents.

What is claimed is:

1. An apparatus for redirecting fluid flow therethrough, the apparatus comprising:

a flow passage extending in the apparatus;

a flow region in communication with the flow passage;

a tool operative in conjunction with fluid in the flow region; and multiple flow restrictors in the flow passage, the flow restrictors being operative to influence at least a portion of the fluid to flow from the flow passage to the flow region, and the flow restrictors being positioned circumscribing the flow passage.

2. The apparatus according to claim 1, wherein the flow restrictors include projections extending into the flow passage.

3. The apparatus according to claim 2, wherein the projections are generally annular-shaped.

4. The apparatus according to claim 1, wherein the flow restrictors include recesses extending outwardly from the flow passage into a sidewall surrounding the flow passage.

5. The apparatus according to claim 1, wherein a resistance to fluid flow through the flow restrictors varies in response to a rate of fluid flow through the flow passage.

6. The apparatus according to claim 1, wherein a internal dimension permitting access through the flow restrictors varies in response to a rate of fluid flow through the flow passage.

7. The apparatus according to claim 1, wherein the flow restrictors influence the fluid to rotate about a longitudinal axis of the flow passage.

8. The apparatus according to claim 1, wherein the flow restrictors form alternating fluid expansion and contraction regions in the flow passage.

9. The apparatus according to claim 1, wherein the flow restrictors are generally helically configured about the flow passage.

10. The apparatus according to claim 1, wherein the tool is an electrical power generator which operates in response to fluid flow through the flow region.

11. An electrical power generating system for use in a subterranean well, the system comprising:

a first flow passage formed through a tubular string in the well;

a flow region in communication with the first flow passage;

an electrical power generator operative in response to flow of fluid through the flow region; and multiple flow restrictors in the first flow passage, the flow restrictors being operative to influence at least a portion of the fluid to flow from the first flow passage through the flow region, and the flow restrictors being positioned circumscribing the first flow passage.

12. The system according to claim 11, wherein the flow region comprises a second flow passage, and wherein each of a flow inlet and a flow outlet of the second flow passage is in communication with the first flow passage.

13. The system according to claim 11, wherein the flow region comprises a lateral extension of the first flow passage, with no flow barrier between the first flow passage and the flow region.

14. The system according to claim 11, wherein the flow restrictors influence the fluid to rotate about a longitudinal axis of the first flow passage.

15. The system according to claim 11, wherein the flow restrictors comprise generally annular-shaped rings projecting inwardly into the first flow passage.

16. The system according to claim 15, wherein each of the rings has a generally rectangular cross-section.

17. The system according to claim 15, wherein each of the rings has a generally wedge-shaped cross-section.

18. The system according to claim 17, wherein a laterally inclined face of each of the rings is oriented in an upstream direction relative to the first flow passage.

19. The system according to claim 15, wherein the rings are generally helically configured.

20. The system according to claim 15, wherein the rings influence the fluid to rotate about a longitudinal axis of the first flow passage.

21. The system according to claim 11, wherein the flow restrictors comprise projections extending into the first flow passage, the projections being spaced apart in the first flow passage.

22. The system according to claim 21, wherein the projections are circumferentially and longitudinally spaced apart in the first flow passage.

23. The system according to claim 21, wherein the projections are helically distributed in the first flow passage.

24. The system according to claim 21, wherein the projections influence the fluid to rotate about a longitudinal axis of the first flow passage.

25. The system according to claim 21, wherein each of the projections has a generally rectangular cross-section.

26. The system according to claim 21, wherein each of the projections has a generally wedge-shaped cross-section.

27. The system according to claim 26, wherein a laterally inclined face of each of the projections faces in an upstream direction relative to the first flow passage.

28. The system according to claim 21, wherein each of the projections has a generally hemispherical shape.

29. The system according to claim 21, wherein each of the projections has a generally tetrahedron shape.

30. The system according to claim 21, wherein each of the projections has a generally pyramid shape.

31. The system according to claim 21, wherein fluid flow between first and second ones of the projections is directed to impinge on a third one of the projections.

32. The system according to claim 21, wherein each of the projections is a whisker.

33. The system according to claim 32, wherein the whiskers are grouped into spaced apart bands in the first flow passage.

34. The system according to claim 33, wherein the bands form alternating fluid expansion and contraction regions in the first flow passage.

35. The system according to claim 11, wherein the flow restrictors comprise recesses formed in a wall surrounding the first flow passage.

36. The system according to claim 35, wherein each of the recesses has a generally rectangular profile.

37. The system according to claim 35, wherein each of the recesses has a generally wedge-shaped profile.

38. The system according to claim 37, wherein a laterally inclined face of the profile faces in an upstream direction relative to the first flow passage.

39. The system according to claim 35, wherein the recesses are generally annular-shaped.

40. The system according to claim 35, wherein the recesses are generally helically configured about the flow passage.

41. The system according to claim 35, wherein the recesses influence the fluid to rotate about a longitudinal axis of the first flow passage.

42. The system according to claim 11, wherein the flow restrictors are formed on a generally bellows-shaped device.

43. The system according to claim 42, wherein the device is expandable in a longitudinal direction relative to the first flow passage.

44. The system according to claim 42, wherein the device has a minimum internal dimension which varies in response to a rate of fluid flow through the first flow passage.

45. The system according to claim 44, wherein the minimum internal dimension decreases as the rate of fluid flow increases.

46. The system according to claim 44, further comprising a biasing device which biases the bellows-shaped device to a configuration in which the minimum internal dimension is at a maximum value.

47. The system according to claim 42, wherein the device increasingly influences the fluid to flow through the flow region, instead of through the first flow passage, as the rate of fluid flow increases.

48. The system according to claim 11, wherein the flow restrictors are grouped in longitudinally spaced apart sets of multiple ones of the flow restrictors which thereby form alternating fluid expansion and contraction regions in the first flow passage.

49. The system according to claim 11, wherein the flow restrictors are positioned upstream of the flow region.

50. The system according to claim 49, wherein the flow restrictors influence the fluid to rotate about a longitudinal axis of the first flow passage, thereby directing the fluid to flow laterally into the flow region.

51. The system according to claim 11, wherein the flow restrictors are helically configured relative to a longitudinal axis of the first flow passage.

52. The system according to claim 11, wherein the flow restrictors have multiple different spacings therebetween.

53. The system according to claim 52, wherein the different spacings are alternated along the first flow passage.

54. The system according to claim 11, wherein the flow restrictors have multiple different sizes.

55. The system according to claim 11, wherein the flow restrictors are grouped into multiple sets of the flow restrictors, a first set of the flow restrictors influencing the fluid to rotate in a first direction relative to a longitudinal axis of the first flow passage, and a second set of the flow restrictors influencing the fluid to rotate in a second direction opposite to the first direction relative to the first flow passage axis.

56. The system according to claim 55, wherein each of the sets includes multiple ones of the flow restrictors.

57. The system according to claim 11, wherein each of the flow restrictors has an opening formed therethrough, and wherein the fluid flows through the openings when the fluid flows through the first flow passage.

58. An apparatus for redirecting fluid flow therethrough, the apparatus comprising:

a first flow passage extending in the apparatus, the first flow passage being configured for flow of fluid therethrough, and for well tool access therethrough;

a flow region in communication with the first flow passage on a lateral side of the first flow passage; and multiple flow restrictors in the first flow passage, the flow restrictors influencing the fluid to flow away from the first flow passage.

59. The apparatus according to claim 58, wherein the flow restrictors influence the fluid to flow toward the flow region.

60. The apparatus according to claim 58, wherein the flow restrictors influence the fluid to flow toward an electrical power generator in the flow region.

61. The apparatus according to claim 58, wherein the flow restrictors influence the fluid to flow toward a fluid sampler in the flow region.

62. The apparatus according to claim 58, wherein the flow restrictors influence the fluid to flow toward a fluid sensor in the flow region.

63. The apparatus according to claim 58, wherein the flow region is laterally recessed into a sidewall of the first flow passage.

64. The apparatus according to claim 58, wherein the flow region is formed in a second flow passage at least partially isolated from the first flow passage by a wall therebetween.

* * * * *